US010733968B2

(12) United States Patent
Cacciolo

(10) Patent No.: US 10,733,968 B2
(45) Date of Patent: Aug. 4, 2020

(54) MAGNETIC RESISTANCE SYSTEM FOR USE WITH DRUM SETS

(71) Applicant: Mo Drumsticks LLC, Freehold, NJ (US)

(72) Inventor: Thino Cacciolo, Freehold, NJ (US)

(73) Assignee: MO DRUMSTICKS LLC, Freehold, NJ (US)

( * ) Notice: Subject to any disclaimer, the term of this patent is extended or adjusted under 35 U.S.C. 154(b) by 0 days.

(21) Appl. No.: 16/500,791

(22) PCT Filed: Apr. 4, 2018

(86) PCT No.: PCT/IB2018/052342

§ 371 (c)(1),
(2) Date: Oct. 3, 2019

(87) PCT Pub. No.: WO2018/185687

PCT Pub. Date: Oct. 11, 2018

(65) Prior Publication Data

US 2020/0111459 A1 Apr. 9, 2020

Related U.S. Application Data

(60) Provisional application No. 62/481,271, filed on Apr. 4, 2017, provisional application No. 62/560,766, filed on Sep. 20, 2017.

(51) Int. Cl.
*G10D 13/11* (2020.01)

(52) U.S. Cl.
CPC ..... *G10D 13/11* (2020.02)

(58) Field of Classification Search
CPC ..... G10D 13/11
See application file for complete search history.

(56) References Cited

U.S. PATENT DOCUMENTS

| | | | | |
|---|---|---|---|---|
| 7,119,264 | B2 | 10/2006 | Van Dyk | |
| 8,008,560 | B2 | 8/2011 | Wiese et al. | |
| 2013/0291706 | A1 | 11/2013 | Van Dyk | |
| 2017/0092242 | A1* | 3/2017 | Shigenaga | G10D 13/02 |

FOREIGN PATENT DOCUMENTS

DE 202010002375 5/2010

* cited by examiner

*Primary Examiner* — Kimberly R Lockett

(57) ABSTRACT

A magnetic resistance system for use with drum sets that allows for various levels of magnetic repulsion between a drum beater and a batter head. A drum beater having a beater magnet is used in conjunction with an impact pad having an impact magnet. The drum beater is attached to a drum pedal, while the impact pad is integrated with the batter head of the drum, either directly or through a suspension bracket. The beater magnet and the impact magnet are oriented to repel each other as the drum beater is driven towards the batter head, thus creating an additional bounce back of the drum beater from the batter head of the drum. One or more subsequent impact pads may be interchanged or stacked with the impact pad in order to further increase the bounce back of the drum beater from the batter head.

16 Claims, 21 Drawing Sheets

SECTION A-A

SECTION A-A

MAGNETIC RESISTANCE SYSTEM FOR USE WITH DRUM SETS

The current application is a 371 of international Patent Cooperation Treaty (PCT) application PCT/IB2018/052342 filed on Apr. 4, 2018. The PCT application PCT/IB2018/052342 claims a priority to the U.S. Provisional Patent application Ser. No. 62/481,271 filed on Apr. 4, 2017 and to the U.S. Provisional Patent application Ser. No. 62/560,766 filed on Sep. 20, 2017.

FIELD OF THE INVENTION

The present invention relates generally to musical instruments. More specifically, the present invention is a magnetic resistance system for use with drum sets that allows for various levels of magnetic repulsion between a drum beater and a batter head.

BACKGROUND OF THE INVENTION

A drum kit includes a combination of drums and other percussion instruments. A standard drum kit comprises a bass drum, a floor tom, a snare drum, hanging toms, and various cymbals. Many drummers choose to personalize their kits adding many other instruments, depending on the style of music they perform. The basic apparatus however remains largely unchanged; therefore, the innate musical talent and skills of the drummer are at the centerpiece of any musical performance. Kick/bass drums as they are more commonly known, are foot activated percussion instruments, used to add a deeper tone, and to mark or keep time. The bass drum can be operated by foot or by hand. Most foot operated bass drum pedals have the same overall working principles. The drummer presses onto a pedal which transfers the forces applied by the user, to a linkage. The linkage moves the drum beater in sync with the motion of the user's foot, creating a distinct rhythm. Pedals used in these types of assemblies can have various linkage adjustment mechanisms, allowing for different levels of resistance. Drummers are limited in terms of customizing the sound and frequency of the instrument. The combination of the linkage mechanism and the materials used in the beater allow the musicians to make alterations in the sound created by the instrument. Adding dual pedals for both feet, may be another option to consider. The present invention aims to enhance and solve some of the problems mentioned above by providing an additional method of controlling the tension, resistance and ease of playing the bass drum.

Most drums maintain the same basic construction components, including a drum shell, a drum hoop, a drum head, lugs and tension rods. Due to the possibility of distorting the sound, some drummers avoid attaching accessories directly onto the surface of the drum head itself. The sound quality and accuracy is a critical aspect and most drummers are adamant about providing a quality acoustic experience for the audience.

Therefore it is an object of the present invention to provide a magnetic resistance system for use with drum sets that allows for various levels of magnetic repulsion between a bass (kick) drum beater (or other type of drum beater) and a batter head. A drum beater having a beater magnet is used in conjunction with an impact pad having an impact magnet. The drum beater is attached to a drum pedal, while the impact pad is integrated with the batter head of the drum, either directly or through a suspension bracket. The beater magnet and the impact magnet are oriented to repel each other as the drum beater is driven towards the batter head, thus creating additional push back (repulsion) of the drum beater from the batter head. One or more subsequent impact pads may be interchanged or stacked with the impact pad in order to further increase the repulsion of the drum beater from the batter head.

DETAIL DESCRIPTIONS OF THE INVENTION

All illustrations of the drawings are for the purpose of describing selected versions of the present invention and are not intended to limit the scope of the present invention.

People often look at ways to innovate and improve the tools and instruments they are working with. The ability to alter the sound and ease of playing a drum kit, is limited by the materials and overall construction. Different materials including metals alloys, felt, rubber and wood may be used in the construction of the beater head, changing the overall resonance of the sound. Thus, the present invention is designed to allow for individual customization of a drum kit, by integrating magnets into the construction of the beater and drum assembly.

Figure 14:
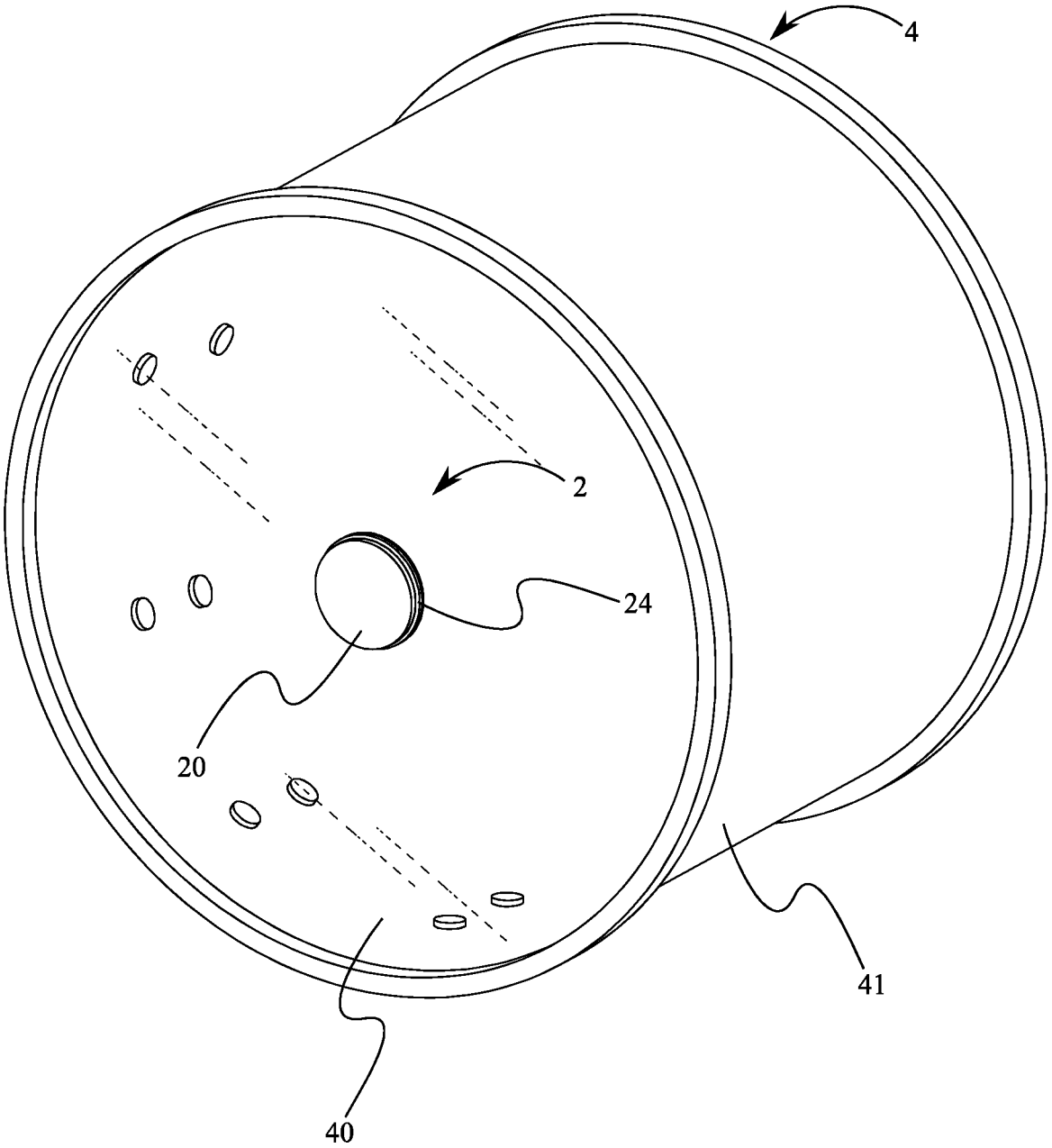
FIG. 14 is a perspective view of a kick drum, wherein the impact pad is mounted onto the batter head.
Figure 15:
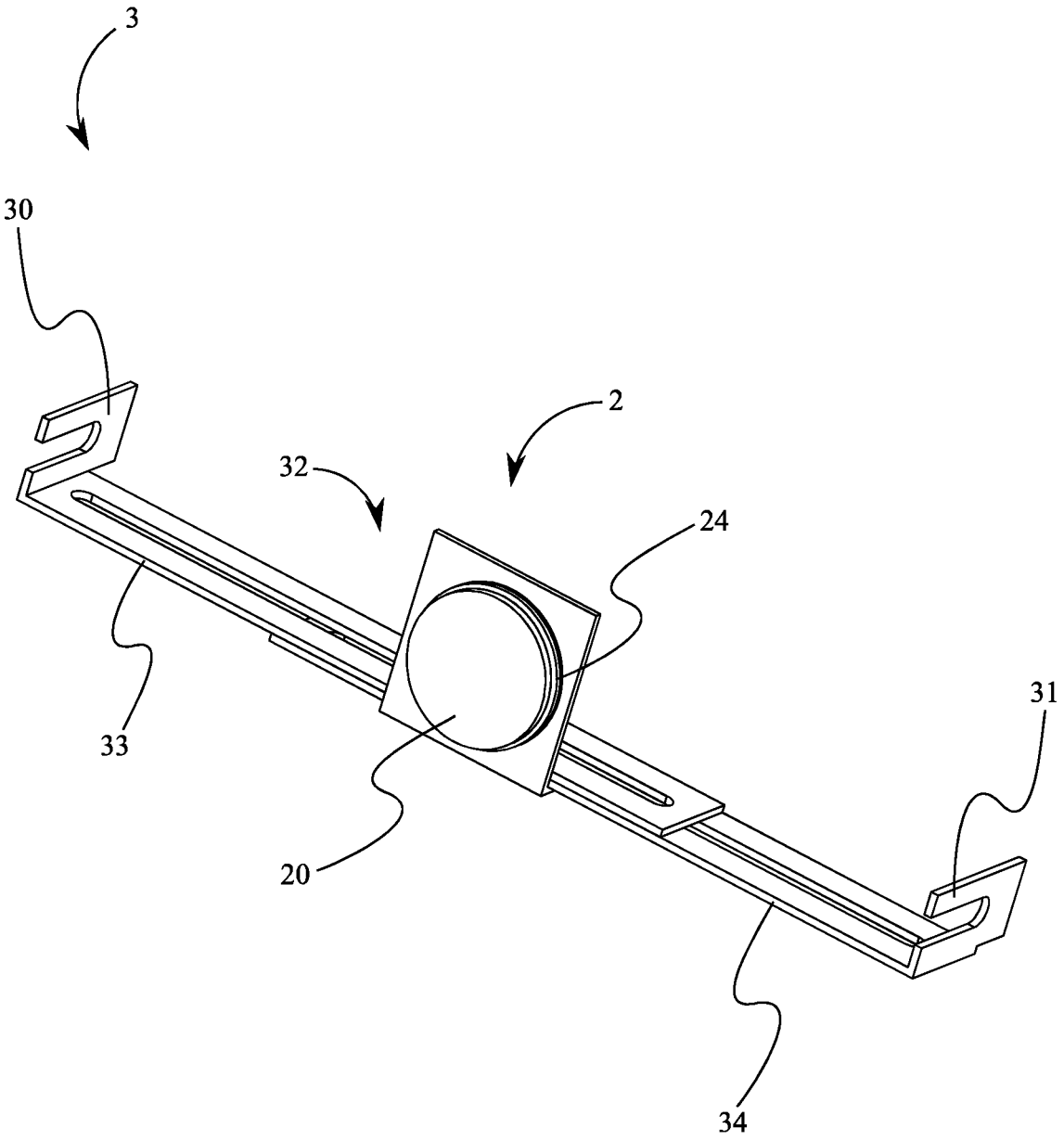
FIG. 15 is a perspective view of the impact pad mounted onto the suspension bracket.
Figure 16:
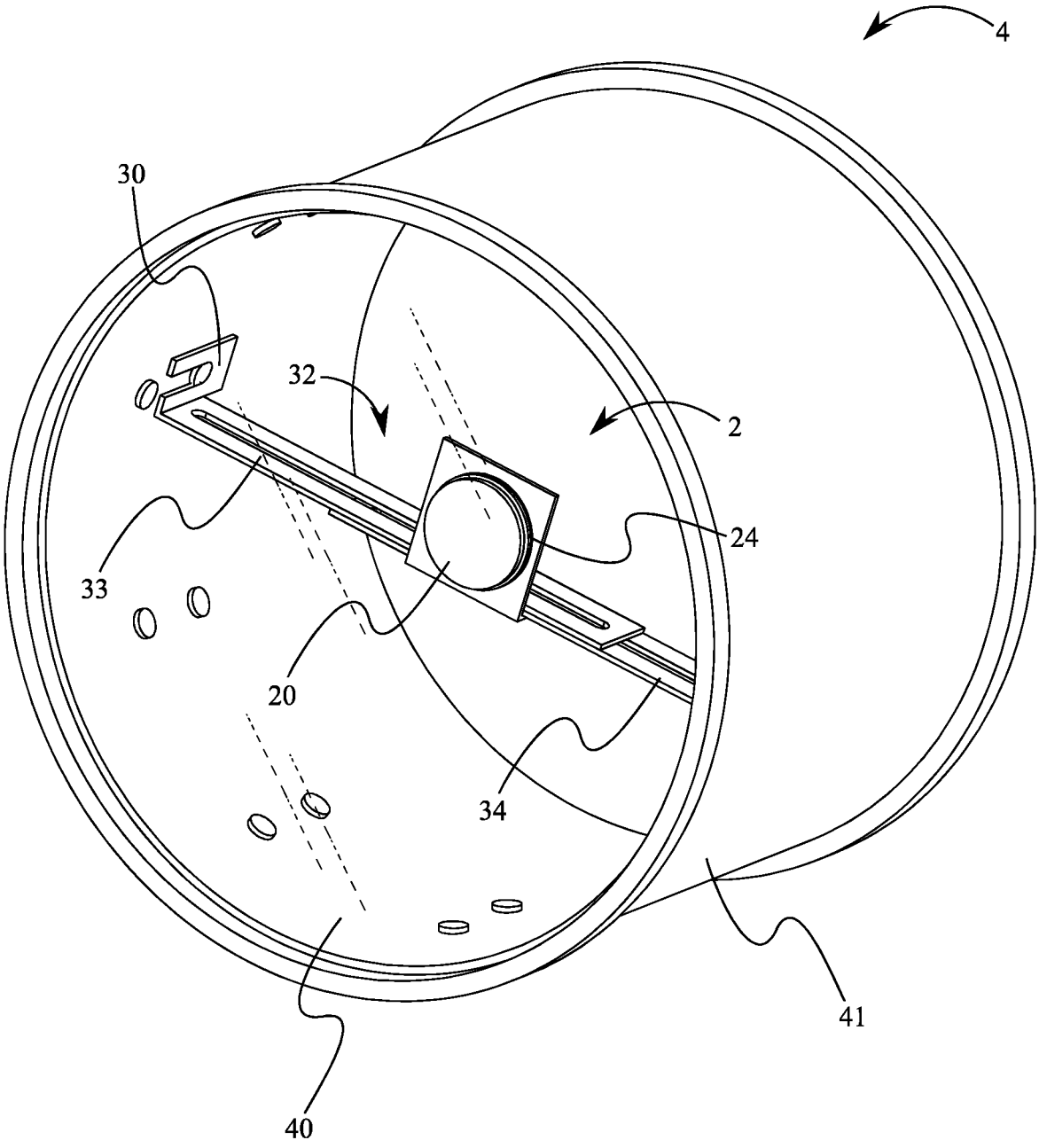
FIG. 16 is a front perspective view of a kick drum, wherein the impact pad is mounted inside the drum shell, adjacent to the batter head, using the suspension bracket.

The present invention is a magnetic resistance system for use with drum sets that allows for various levels of magnetic repulsion between a drum beater 1 and a batter head 40. The present invention comprises a drum beater 1, an impact pad 2, and in some embodiments a suspension bracket 3. In some embodiments, the impact pad 2 is attached directly to the batter head 40 of a kick drum 4, as depicted in FIG. 14. In other embodiments, the impact pad 2 is suspended within the kick drum 4 via the suspension bracket 3, as depicted in FIG. 15-16, wherein the impact pad 2 does not physically interact with the batter head 40. Depending on the embodiment, the impact pad 2 may be removably integrated with the kick drum 4 or permanently integrated with the kick drum 4.

Magnetic components of the drum beater 1 and the impact pad 2 repel each other as the drum beater 1 is driven towards the impact pad 2. The repulsion force creates an enhanced kick back of the drum beater 1 compared to the normal kick back that would occur from striking the batter head 40 alone. Preferably, the present invention is integrated with the kick drum 4 of a drum assembly, wherein the drum beater 1 is attached to a drum pedal. The drum pedal ensures that the drum beater 1 follows a consistent path when the drum pedal is actuated, allowing the drum beater 1 to make consistent contact with the batter head 40 or the impact pad 2. More specifically, the fixed alignment of the drum pedal prevents the drum beater 1 from being repelled to the side of the impact pad 2, as the drum beater 1 is driven towards the batter head 40. Rather, the drum beater 1 is repelled backwards, along the fixed path.'

Furthermore, the use of the present invention with the kick drum 4 of a drum assembly allows the user to loosen the springs or linkage of the drum pedal that provide resistance when depressing the drum pedal. In a typical kick drum assembly, if the springs or linkage is loosened too much, there will not be enough restoring force in the drum pedal to return the beater to the original position. Because the present invention provides a new restoring force, external to the drum pedal, to return the drum beater 1 to the original position, the springs or linkage in the drum pedal can be loosened to allow the drum pedal to be more easily depressed. This reduces the fatigue of the drummer, allows the drummer to play faster, and provides other benefits that come with the reduced strain on the drummer. This also allows individuals with lower body disabilities that cause decreased strength, limited mobility, etc. to fully utilize a drum set. While the present invention is preferably implemented with the kick drum 4 of a drum set, as herein described, it is to be know that the present invention can also be implemented with or drum types.

Figure 1:
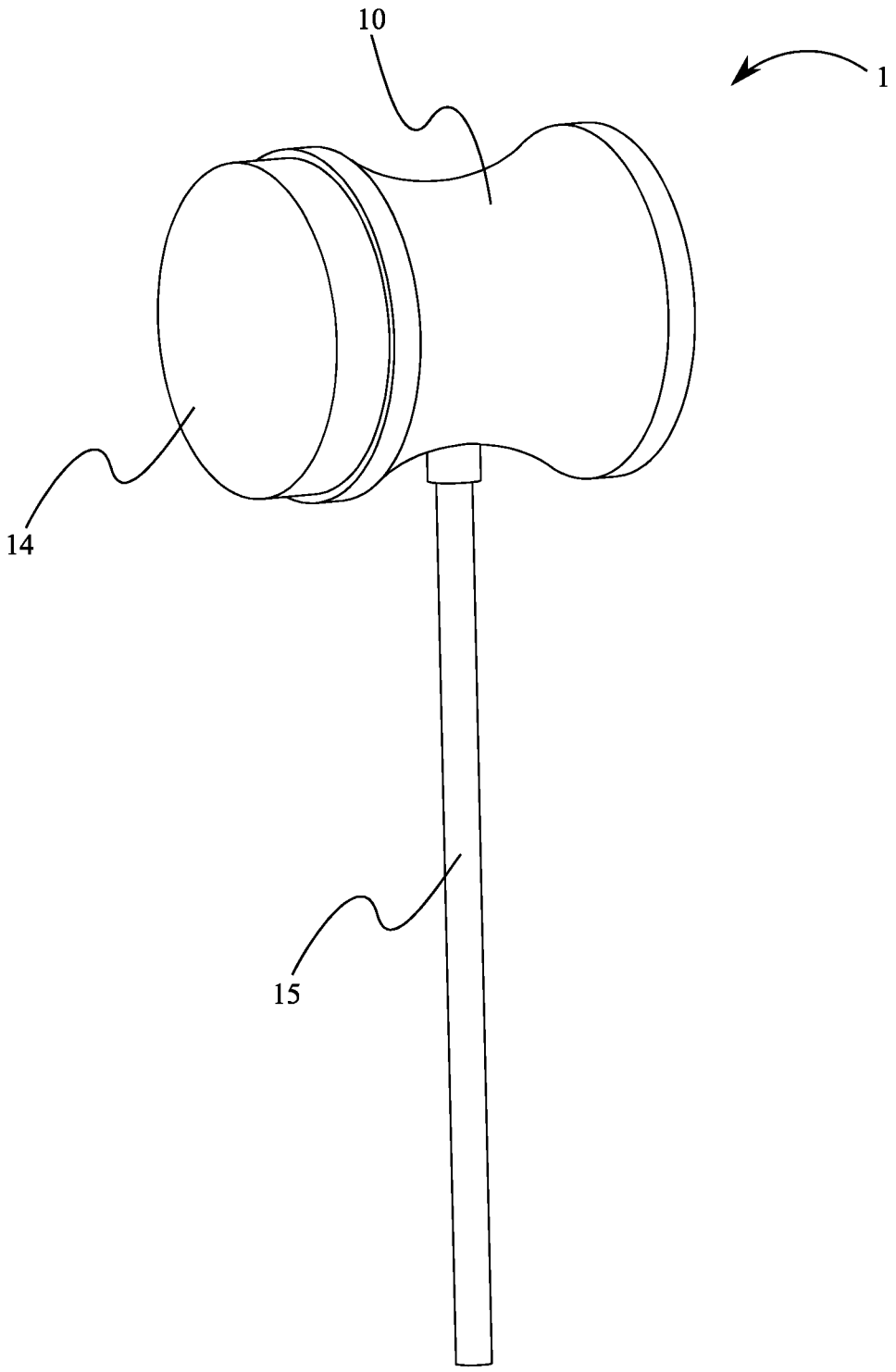
FIG. 1 is a perspective view of the drum beater.
Figure 2:
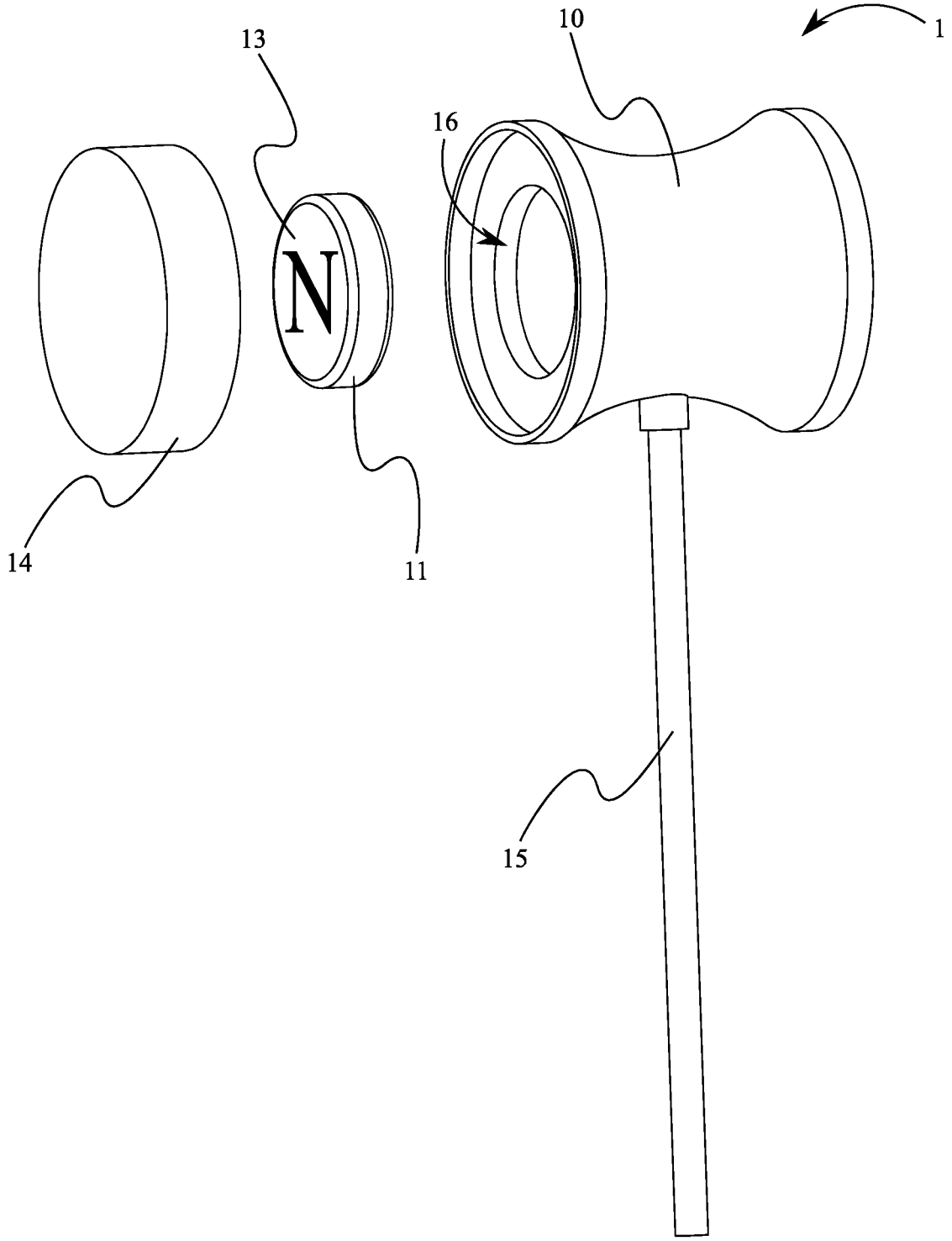
FIG. 2 is a front exploded view of the drum beater, wherein the first pole of the beater magnet is a north pole.
Figure 3:
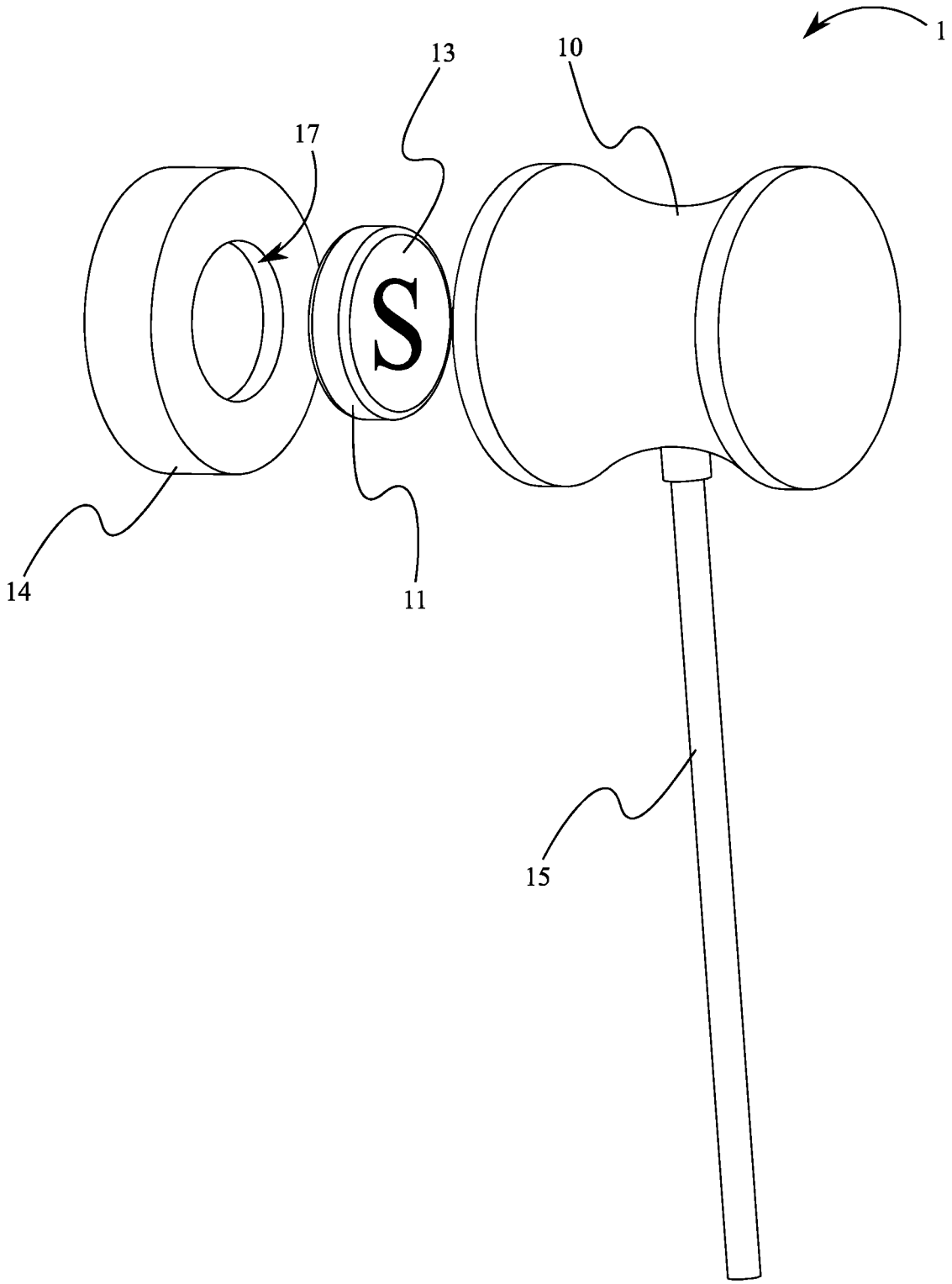
FIG. 3 is a rear exploded view of the drum beater, wherein the second pole of the beater magnet is a south pole.
Figure 4:
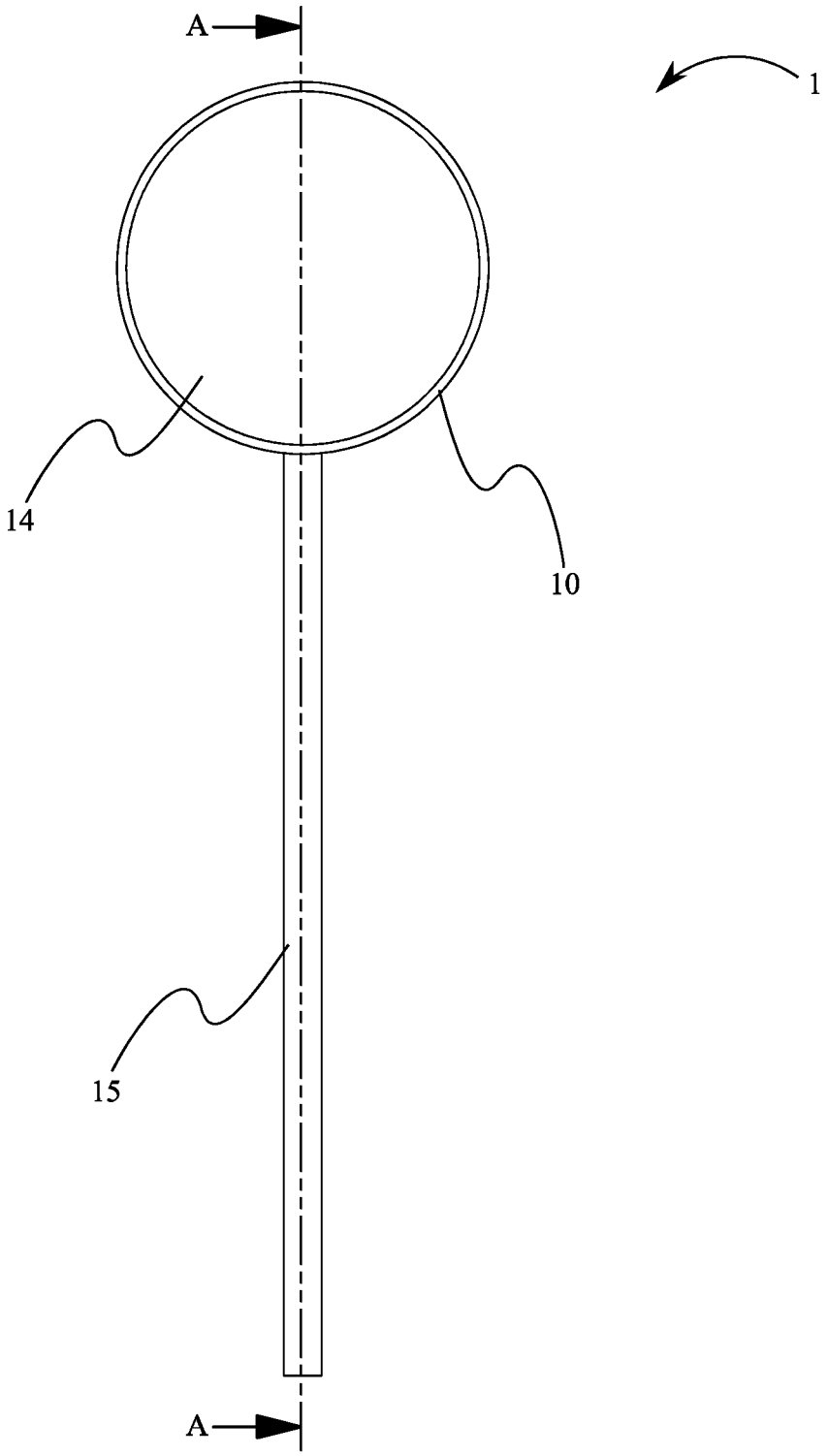
FIG. 4 is a front view of the drum beater showing the plane A-A along which a cross section is taken and shown in FIG. 5.
Figure 5:
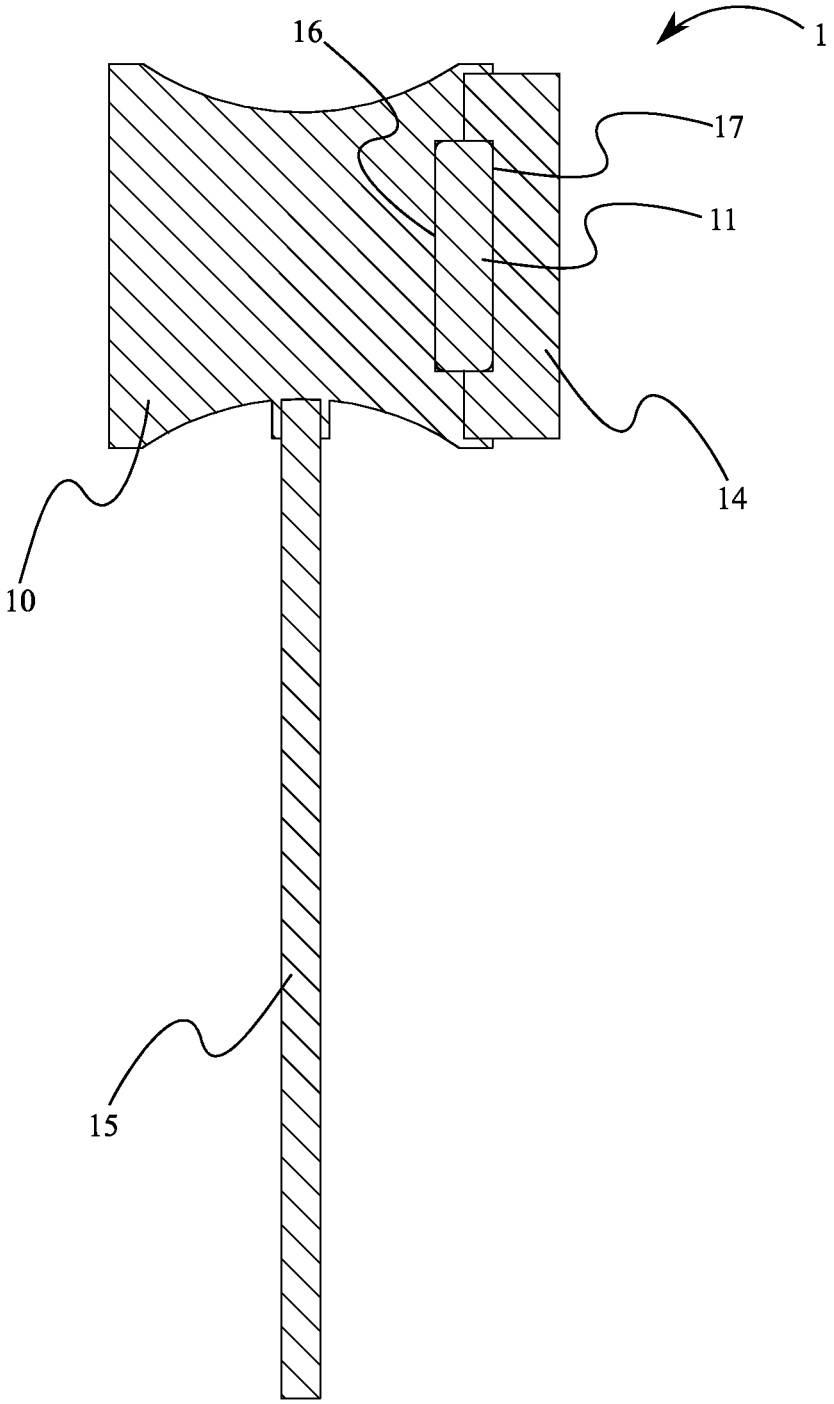
FIG. 5 is a cross section view of the drum beater about plane A-A of FIG. 4, showing the beater magnet positioned into the first beater recess and the second beater recess.

In reference to FIG. 1-3, the drum beater 1 comprises a beater head 10, a beater magnet 11, a beater pad 14, and a support rod 15. The beater head 10 is a weighted body that is used to generate an impact force for striking the batter head 40 of the kick drum 4. The beater head 10 is terminally connected to the support rod 15, wherein the opposing end of the support rod 15 is connected to a drum pedal, and wherein actuation of the drum pedal drives the movement of the beater head 10 via the support rod 15. The beater pad 14 provides the striking surface of the drum beater 1 that makes contact with the batter head 40 when the drum pedal is actuated. As such, the beater pad 14 is adjacently connected to the beater head 10. Meanwhile, the beater magnet 11 is embedded between the beater head 10 and the beater pad 14, as depicted in FIG. 5.

The support rod 15 is an elongated body that allows the beater head 10 to generate momentum as the drum pedal is depressed and the support rod 15 is subsequently pivoted about a fulcrum of the drum pedal. Preferably, the support rod 15 is a thin cylindrical body; however, the support rod 15 is not limited this shape. In some embodiments, the support rod 15 may be hinged to allow the angle of the beater head 10 to be adjusted. The beater head 10 may be removably attached or permanently affixed to the support rod 15. For example, in some embodiments the beater head 10 may be threadedly attached to the support rod 15, while in other embodiments the beater head 10 may be secured to the support rod 15 using an adhesive.

The beater pad 14 provides a softer surface material, relative to the material of the beater head 10. The beater head 10 provides the bulk of the weight to generate the impact force for striking the batter head 40, while the beater pad 14 softens the actual contact between the drum beater 1 and the batter head 40 in order to preserve the integrity of the batter head 40 and prevent undue stress to the batter head 40. The beater pad 14 may be removably attached or permanently affixed to the beater head 10. For example, in some embodiments the beater pad 14 may be threadedly attached to the beater head 10, while in other embodiments the beater pad 14 may be secured to the beater head 10 using an adhesive. Embodiments where the beater pad 14 is removable from the beater head 10 allow the beater magnet 11 to be removed and replaced with another magnet having a higher or lower magnetization.

The beater head 10 may be single sided or multi sided and may be formed into several different shapes, such as round, square, or triangular. Depending on the shape and style of the beater head 10, the beater pad 14 may cover one or more surfaces of the beater head 10. The beater pad 14 may be constructed from a number of different materials, including but not limited to foam, felt, nylon, or rubber. The size, shape, and style of the beater head 10, the material of the beater pad 14, and the magnetization of the beater magnet 11 all affect the resonance of the kick drum 4 and the repulsion of the drum beater 1 when the batter head 40 is struck by the drum beater 1.

The beater magnet 11 may be secured within the beater head 10 and the beater pad 14 in a number of different ways. In reference to FIG. 2-3, in some embodiments, a first beater recess 16 is formed into the beater head 10, while a second beater recess 17 is formed into the beater pad 14. Together, the first beater recess 16 and the second beater recess 17 form a cavity into which the beater magnet 11 is positioned, as shown in FIG. 5. The first beater recess 16 may be centered about the striking surface of the beater head 10, in which case the second beater recess 17 is centered about the beater pad 14. This configuration centrally positions the beater magnet 11 about the striking surface of the beater head 10.

The beater magnet 11 may be secured within the first beater recess 16 in a number of ways. In some embodiments, the beater magnet 11 is threadedly engaged with the beater head 10, such that the beater magnet 11 can be screwed into and out of the first beater recess 16. The beater magnet 11 may also be threadedly engaged with the beater pad 14, such that the beater magnet 11 can be screwed into and out of the second beater recess 17. In other embodiments, the beater magnet 11 is secured within the first beater recess 16 using an adhesive such as contact cement, ensuring a permanent bond between the beater head 10 and the beater magnet 11. The beater magnet 11 may also be adhered to the beater pad 14, such that the beater magnet 11 is permanently secured within the second beater recess 17.

Figure 6:
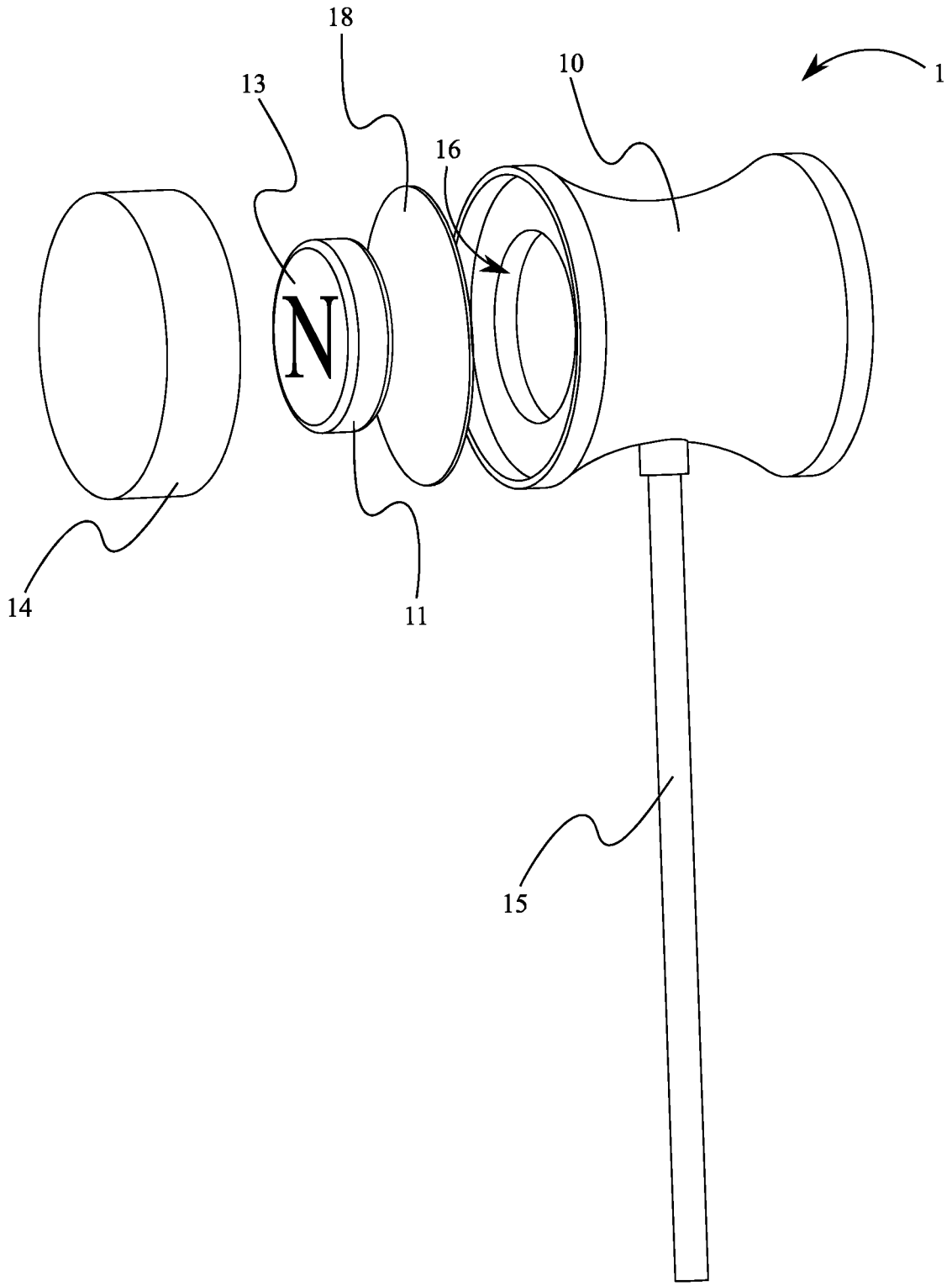
FIG. 6 is an exploded view of the drum beater, wherein a double-sided beater adhesive is positioned between the beater head and both the beater magnet and the beater pad.

In some embodiments, a double-sided beater adhesive 18 is used to bond the beater magnet 11 and the beater pad 14 with the beater head 10. As such, the double-sided beater adhesive 18 is positioned in between the beater head 10 and both the beater magnet 11 and the beater pad 14, as depicted in FIG. 6. Depending on the adhesive properties of the double-sided beater adhesive 18, the beater magnet 11 and the beater pad 14 may be temporarily or permanently bonded to the beater head 10.

The impact pad 2 is integrated with the batter head 40 of the kick drum 4 and is aligned in such a manner as to be impacted by the drum beater 1 as the drum pedal is actuated. In reference to FIG. 7-9, the impact pad 2 comprises a magnet housing 24, an impact cover 20, and an impact magnet 21. The magnet housing 24 provides a mounting surface that is engaged with either the batter head 40 or the suspension bracket 3. Furthermore, the magnet housing 24 supports and houses the impact magnet 21. The impact cover 20 is adjacently connected to the magnet housing 24, wherein the impact magnet 21 is embedded between the magnet housing 24 and the impact cover 20. The impact magnet 21 is oriented within the magnet housing 24 and the impact cover 20 to repel the beater magnet 11, thus affecting the force with which the batter head 40 is struck and in turn altering the resonance of the batter head 40 and creating a level of repulsion between the drum beater 1 and the impact pad 2 which is attached to the batter head 40.

Figure 7:
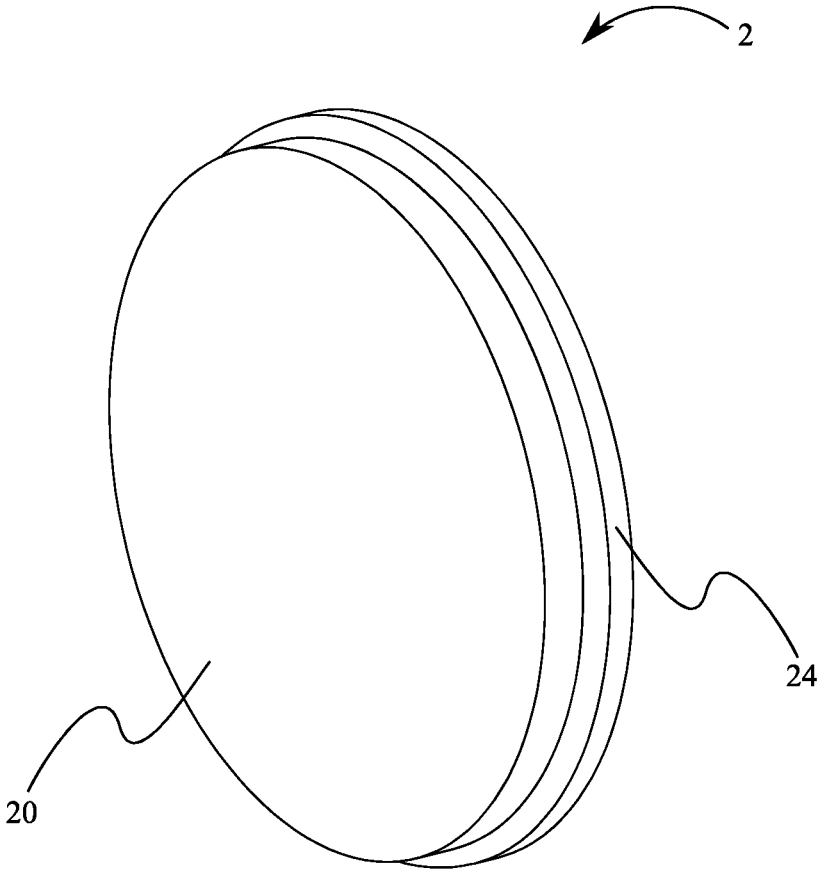
FIG. 7 is a perspective view of the impact pad.
Figure 8:
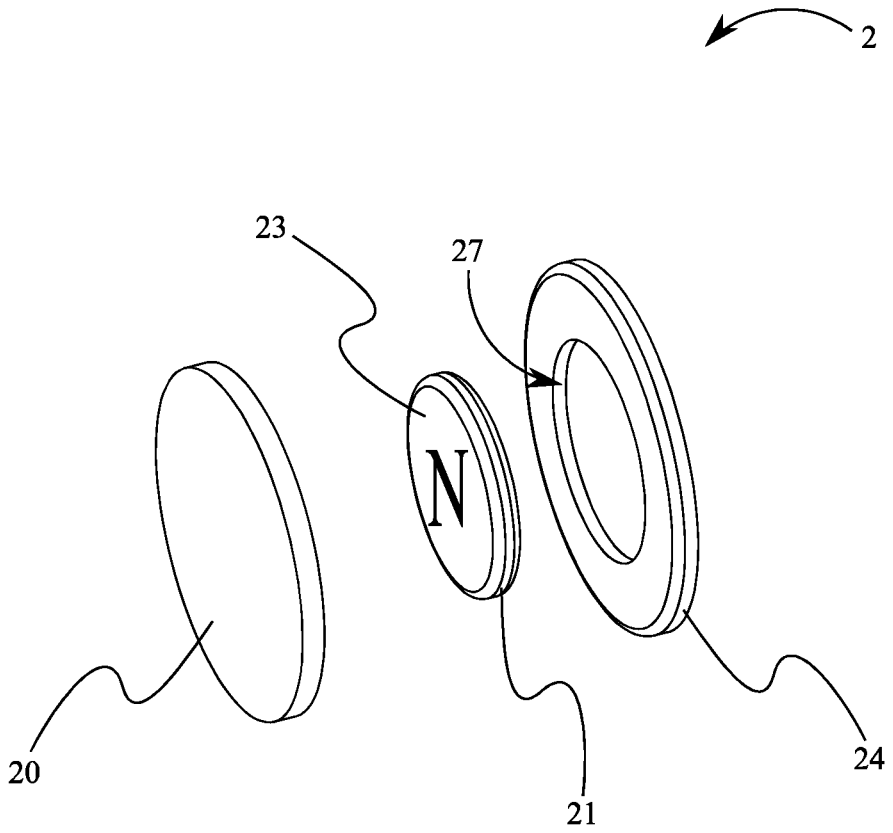
FIG. 8 is a front exploded view of the impact pad, wherein the first pole of the impact magnet is a north pole.
Figure 9:
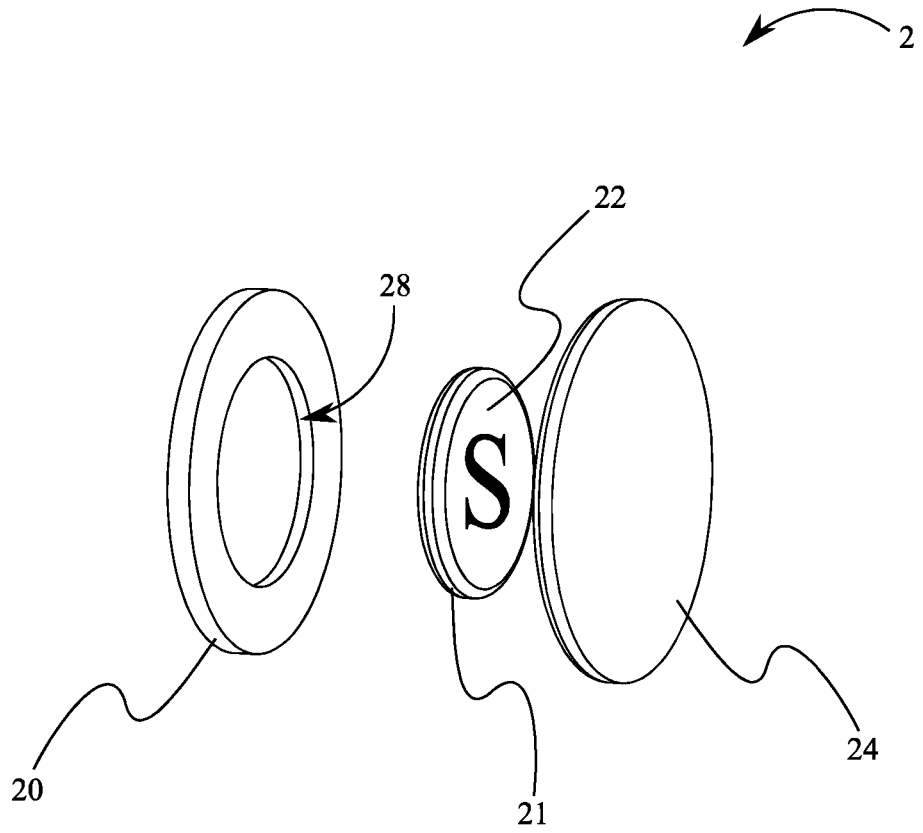
FIG. 9 is a rear exploded view of the impact pad, wherein the second pole of the impact magnet is a south pole.
Figure 10:
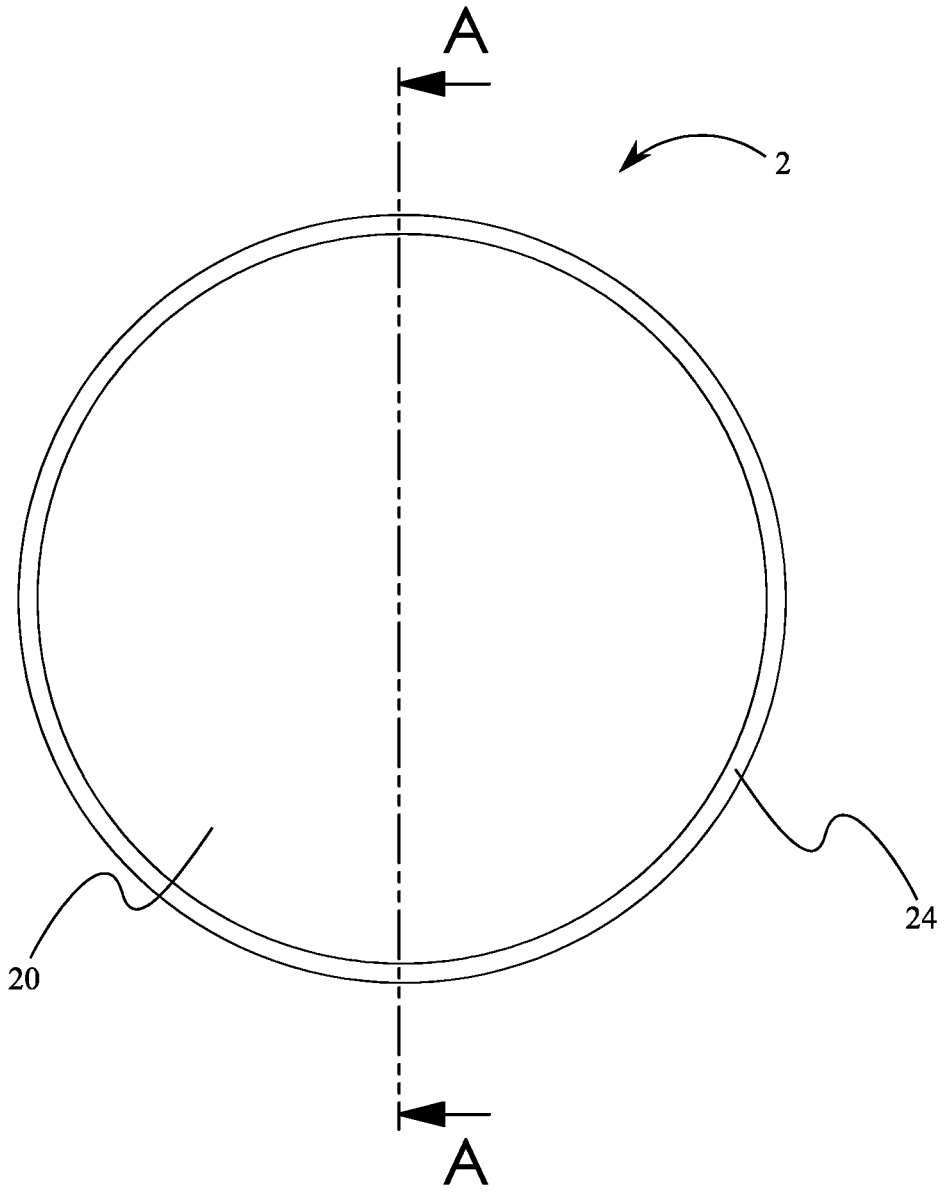
FIG. 10 is a front view of the impact pad, showing the plane A-A about which a cross section is taken and shown in FIG. 11.

The beater magnet 11 has a first pole 12 and a second pole 13; one being the north pole of the beater magnet 11 and the other being the south pole of the beater magnet 11, as depicted in FIG. 2-3. Similarly, the impact magnet 21 has a first pole 22 and a second pole 23; one being the north pole of the impact magnet 21 and the other being the south pole of the impact magnet 21, as depicted in FIG. 7-8. The first pole 12 of the beater magnet 11 and the first pole 22 of the impact magnet 21 have the same polarity, and the second pole 13 of the beater magnet 11 and the second pole 23 of the impact magnet 21 have the same polarity. The first pole 12 of the beater magnet 11 is oriented towards the beater head 10, while the second pole 13 of the beater magnet 11 is oriented towards the beater pad 14. Meanwhile, the first pole 22 of the impact magnet 21 is oriented towards the magnet housing 24, while the second pole 23 of the impact magnet 21 is oriented towards the impact cover 20.

The orientation of the beater magnet 11 and the impact magnet 21 causes the impact pad 2 and the drum beater 1 to repel each other, thus creating additional return force (push back) of the drum beater 1 off of the batter head 40. This repulsive force between the beater magnet 11 and the impact magnet 21 lessens the impact force of the drum beater 1, and thus affects the resonance of the batter head 40 and increases the speed and ease of play. By varying the strength of the beater magnet 11 or the impact magnet 21, the repulsive force can be increased or decreased to achieve the desired resonance by providing an additional method of controlling the tension and resistance of the drum pedal, resulting in an improved ease of playing the drum.

The impact cover 20 provides a softer surface material that lessens the impact between the drum beater 1 and the impact pad 2 in order to preserve the integrity of the impact magnet 21. The impact cover 20 may be constructed from a number of different materials, including but not limited to foam, felt, nylon, or rubber. The impact cover 20 may be removably attached or permanently affixed to the magnet housing 24. For example, in some embodiments the impact cover 20 may be threadedly attached to the magnet housing 24, while in other embodiments the impact cover 20 may be secured to the magnet housing 24 using an adhesive. Embodiments where the impact cover 20 is removable from the magnet housing 24 allow the impact magnet 21 to be removed and replaced with another magnet having a higher or lower magnetization.

Figure 11:
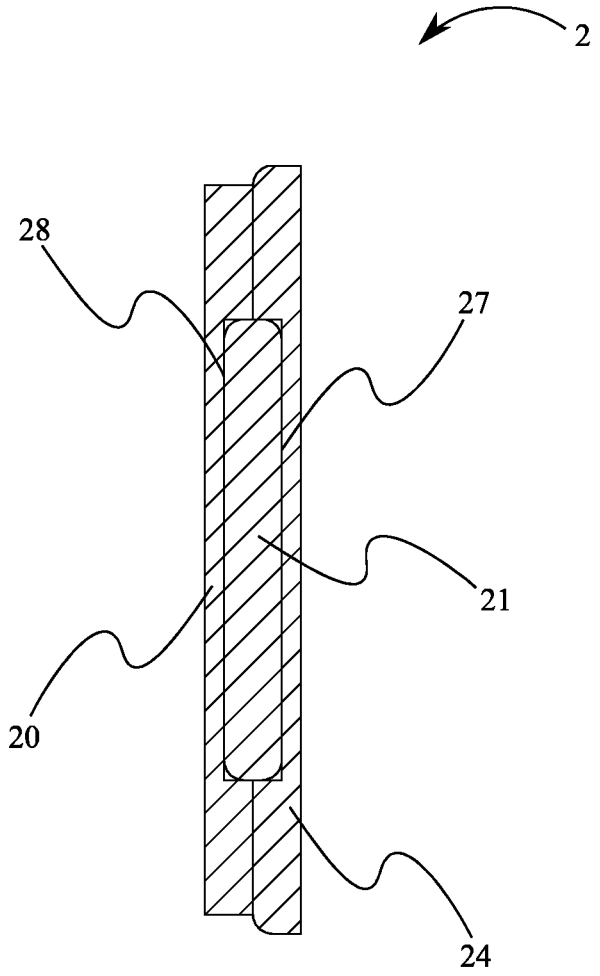
FIG. 11 is a cross section of the impact pad about plane A-A of FIG. 10, showing the impact magnet positioned into the first impact recess and the second impact recess.

The impact magnet 21 may be secured within the magnet housing 24 and the impact cover 20 in a number of different ways. In reference to FIG. 7-8, in some embodiments, a first impact recess 27 is formed into the impact cover 20, while a second impact recess 28 is formed into the impact cover 20. Together, the first impact recess 27 and the second impact recess 28 form a cavity into which the impact magnet 21 is positioned, as depicted in FIG. 11. The first impact recess 27 may be centered about the magnet housing 24, in which case the second impact recess 28 is centered about the impact cover 20. This configuration centrally positions the impact magnet 21 about the impact pad 2.

The impact magnet 21 may be secured within the first impact recess 27 in a number of ways. In some embodiments, the impact magnet 21 is threadedly engaged with the magnet housing 24, such that the impact magnet 21 can be screwed into and out of the first impact recess 27. The impact magnet 21 may also be threadedly engaged with the impact cover 20, such that the impact magnet 21 can be screwed into and out of the second impact recess 28. In other embodiments, the impact magnet 21 is secured within the first impact recess 27 using an adhesive such as contact cement or double-sided tape, ensuring a permanent bond between the magnet housing 24 and the impact magnet 21. The impact magnet 21 may also be adhered to the impact cover 20, such that the impact magnet 21 is permanently secured within the second impact recess 28.

Figure 12:
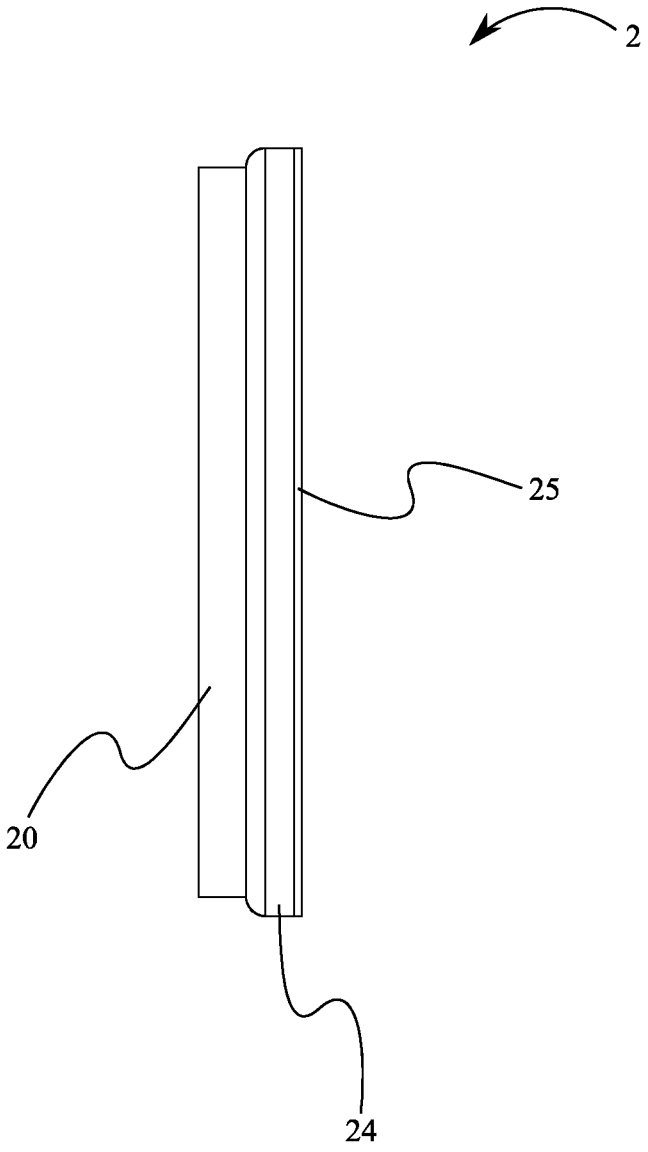
FIG. 12 is a side view of the impact pad, wherein a double-sided adhesive is attached to the magnet housing, opposite the impact cover.

The impact pad 2 can be integrated with the batter head 40 in a number of ways. In some embodiments, the impact pad 2 is secured to the top surface of the batter head 40. Preferably, the impact pad 2 is adhered to the batter head 40 in such embodiments, such as through the use of a double-sided adhesive 25. In reference to FIG. 12, the double-sided adhesive 25 is adhered to the magnet housing 24 opposite the impact cover 20, such that the impact pad 2 can be pressed onto the batter head 40 with the impact cover 20 being oriented away from the batter head 40 in order to receive the strike of the drum beater 1.

Figure 13:
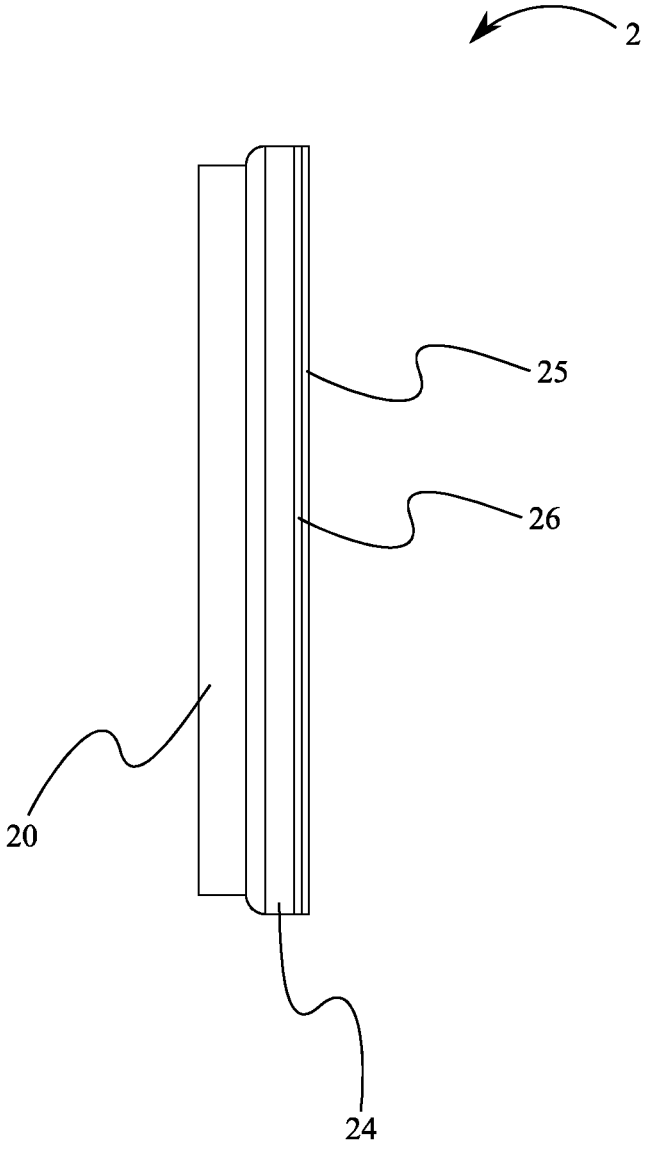
FIG. 13 is a side view of the impact pad, wherein a protective membrane is positioned in between a double-sided adhesive and the magnet housing.

In reference to FIG. 13, in some embodiments, the impact pad 2 further comprises a protective membrane 26 in addition to the double-sided adhesive 25. The protective membrane 26 is adjacently connected to the magnet housing 24 opposite the impact cover 20, while the double-sided adhesive 25 is adhered to the protective membrane 26 opposite the magnet housing 24. In this way, the protective membrane 26 is positioned in between the magnet housing 24 and the double-sided adhesive 25. The protective membrane 26 cushions the magnet housing 24 against the batter head 40 and helps dissipate the impact force to prevent the magnet housing 24 from pushing through the batter head 40 when the impact pad 2 is struck by the drum beater 1. Preferably, the protective membrane 26 is adhered to the magnet housing 24.

Figure 17:
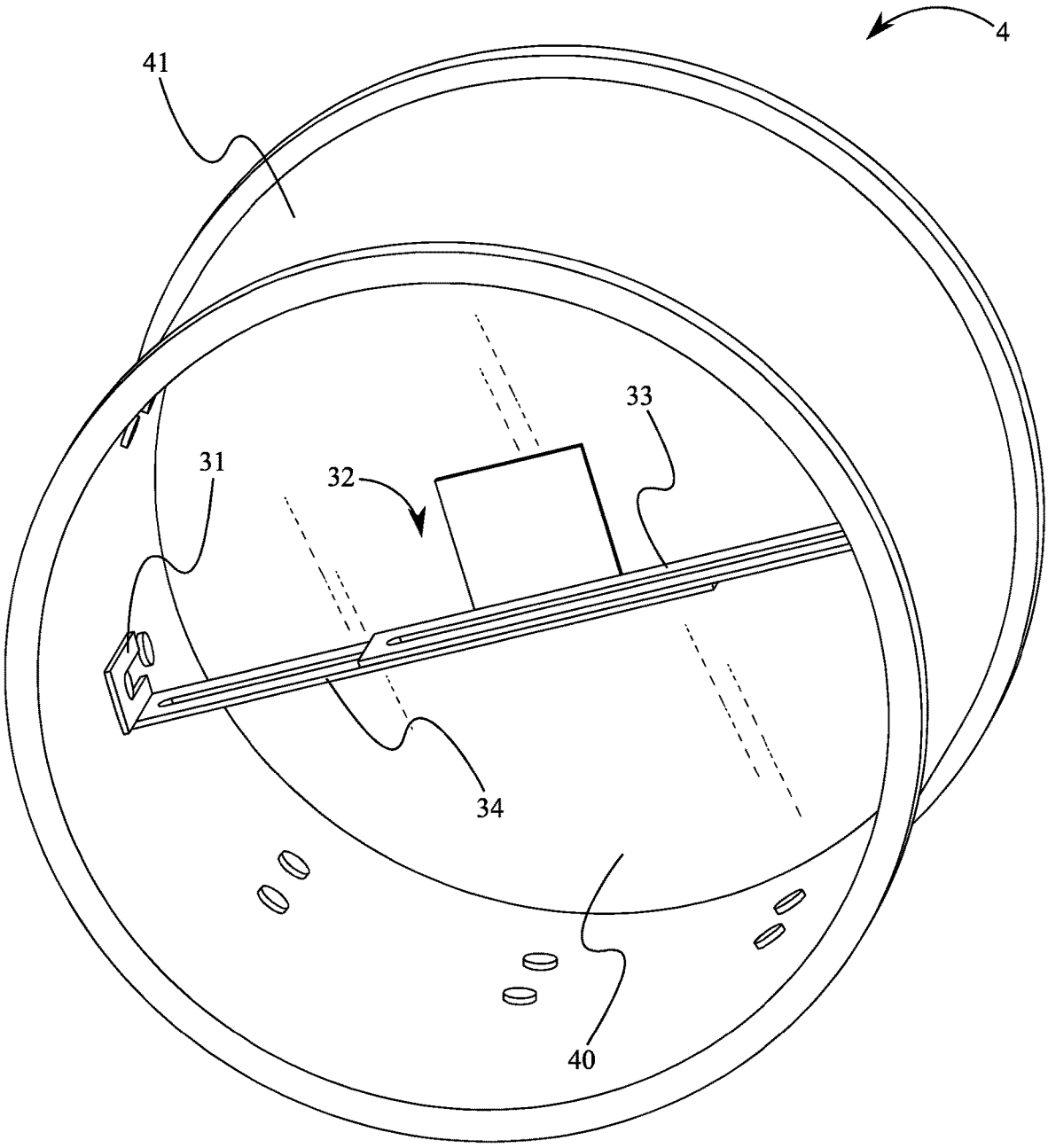
FIG. 17 is a rear perspective view of the kick drum, wherein the impact pad is mounted inside the drum shell, adjacent to the batter head, using the suspension bracket.

In reference to FIG. 15-17, in some embodiments of the present invention, the impact pad 2 is integrated with the kick drum 4 using the suspension bracket 3; the impact pad 2 being mounted to the suspension bracket 3. The suspension bracket 3 is integrated with the drum shell 41 of the kick drum 4, such that the impact pad 2 is suspended behind the batter head 40. The suspension bracket 3 can be removably attached to the drum shell 41 or permanently affixed to the drum shell 41.

In reference to FIG. 15, the suspension bracket 3 comprises a first shell mount 30, a second shell mount 31, and a crossbar 32. The first shell mount 30 and the second shell mount 31 are used to secure the suspension bracket 3 to the drum shell 41, while the crossbar 32 supports the impact pad 2. The first shell mount 30 and the second shell mount 31 are terminally connected to the crossbar 32 opposite each other, such that each end of the crossbar 32 is mounted to the drum shell 41. The impact pad 2 is mounted to the crossbar 32, such that the impact pad 2 is positioned adjacent to the batter head 40.

In reference to FIG. 15-17, in some embodiments of the present invention, the first shell mount 30 and the second shell mount 31 are each a bracket having a central channel. To install the suspension bracket 3 within the drum shell 41, opposing lug screws of the kick drum 4 are first loosened. The suspension bracket 3 is then positioned into the drum shell 41, such that the first shell mount 30 and the second shell mount 31 are positioned about one of the opposing lug screws; each lug screw being slotted into the central channel of either the first shell mount 30 or the second shell mount 31. The opposing lug screws are then tightened, clamping the first shell mount 30 and the second shell mount 31 in place against the inner wall of the drum shell 41.

In reference to FIG. 15, in some embodiments of the present invention, the crossbar 32 comprises a first slide rail 33 and a second slide rail 34. The first slide rail 33 and the second slide rail 34 are slidably engaged with each other, such that the crossbar 32 is able to extend and retract. The variable length of the crossbar 32 in such a configuration allows the suspension bracket 3 to be utilized with kick drums of various size.

Figure 19:
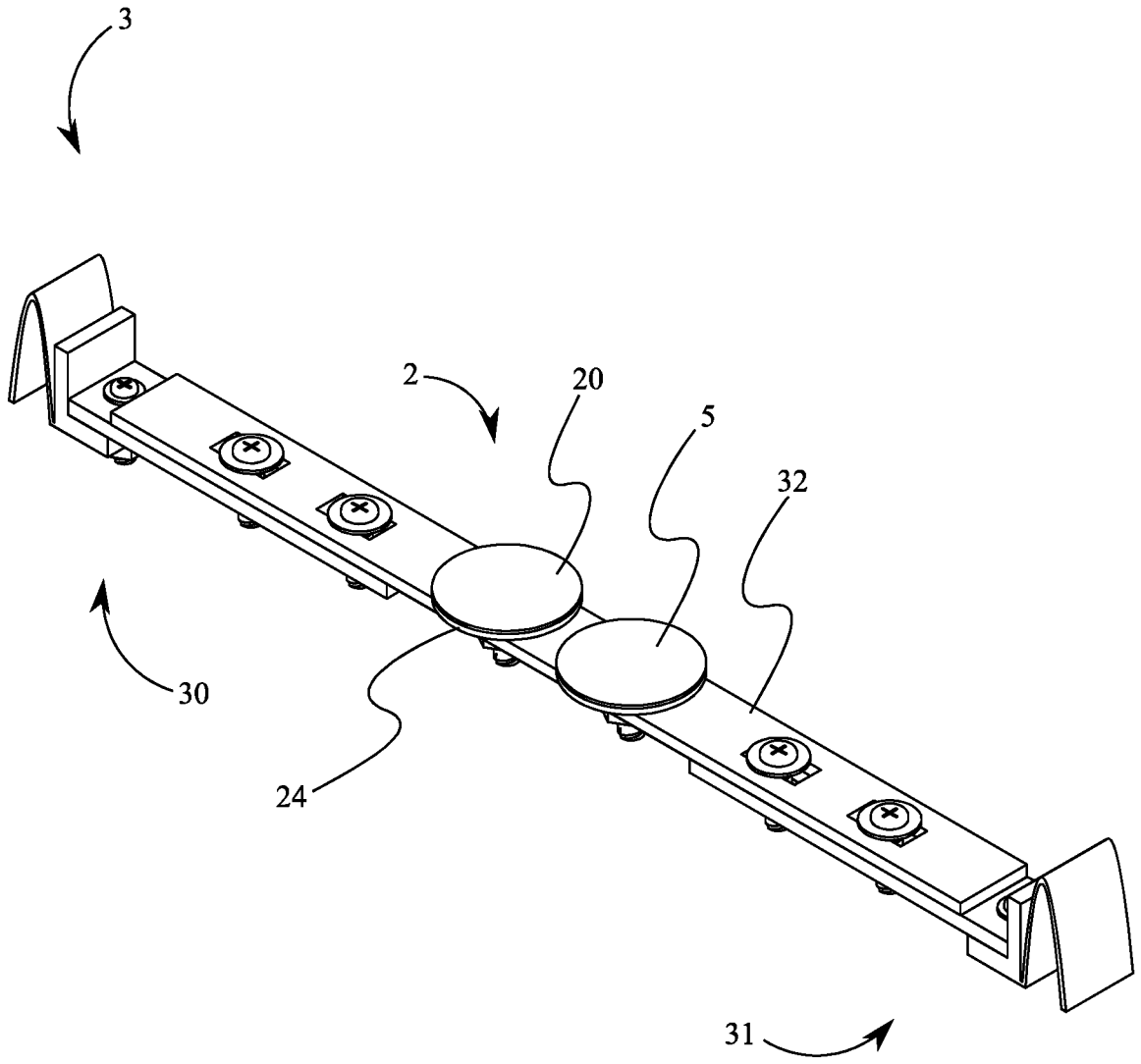
FIG. 19 is an alternative embodiment of the suspension bracket, wherein two impact pads are secured to the cross-bar.

In reference to FIG. 19, in some embodiments of the present invention, the first shell mount 30 and the second shell mount 31 each comprise a V-shaped brace, an L-shaped brace, and a flat bar. The V-shaped brace is adjacently connected to one leg of the L-shaped brace, while the flat bar is adjacently connected to the other leg of the L-shaped brace. The V-shaped brace of both the first shell mount 30 and the second shell mount 31 is clamped around the edge of the drum shell 41, behind the batter head 40, to secure the suspension bracket 3 to the drum shell 41. The flat bar comprises a plurality of channels positioned along the longitudinal center line of the flat bar. The plurality of channels allows the flat bar to be secured to the crossbar 32 using a plurality of fasteners; each fastener traversing through one of the plurality of channels and one of a plurality of slots in the crossbar 32. The fasteners may be an assembly of nuts, bolts, and washers. This fastening method allows the points of contact between the crossbar 32 and both the first shell mount 30 and the second shell mount 31 to be adjusted in order to vary the length of the suspension bracket 3.

In some embodiments, the impact pad 2 may be slidably mounted to the suspension bracket 3. In such embodiment, the crossbar 32 may comprise a central slot through which the impact pad 2 is mounted to the suspension bracket 3. The central slot may be an elongated channel that allows the impact pad 2 to slide parallel or perpendicular to the crossbar 32, depending on the orientation of the central slot. Alternatively, the center slot may employ a cross-shape configuration, allowing the position of the impact pad 2 to be adjusted both vertically and horizontally. A bolt may be adjacently connected to the magnet housing 24 opposite the impact cover 20, wherein the bolt traverses through the central slot. A nut is then tightened along the bolt in order to clamp the crossbar 32 between the nut and the magnet housing 24, thus securing the impact pad 2 in place.

Figure 20:
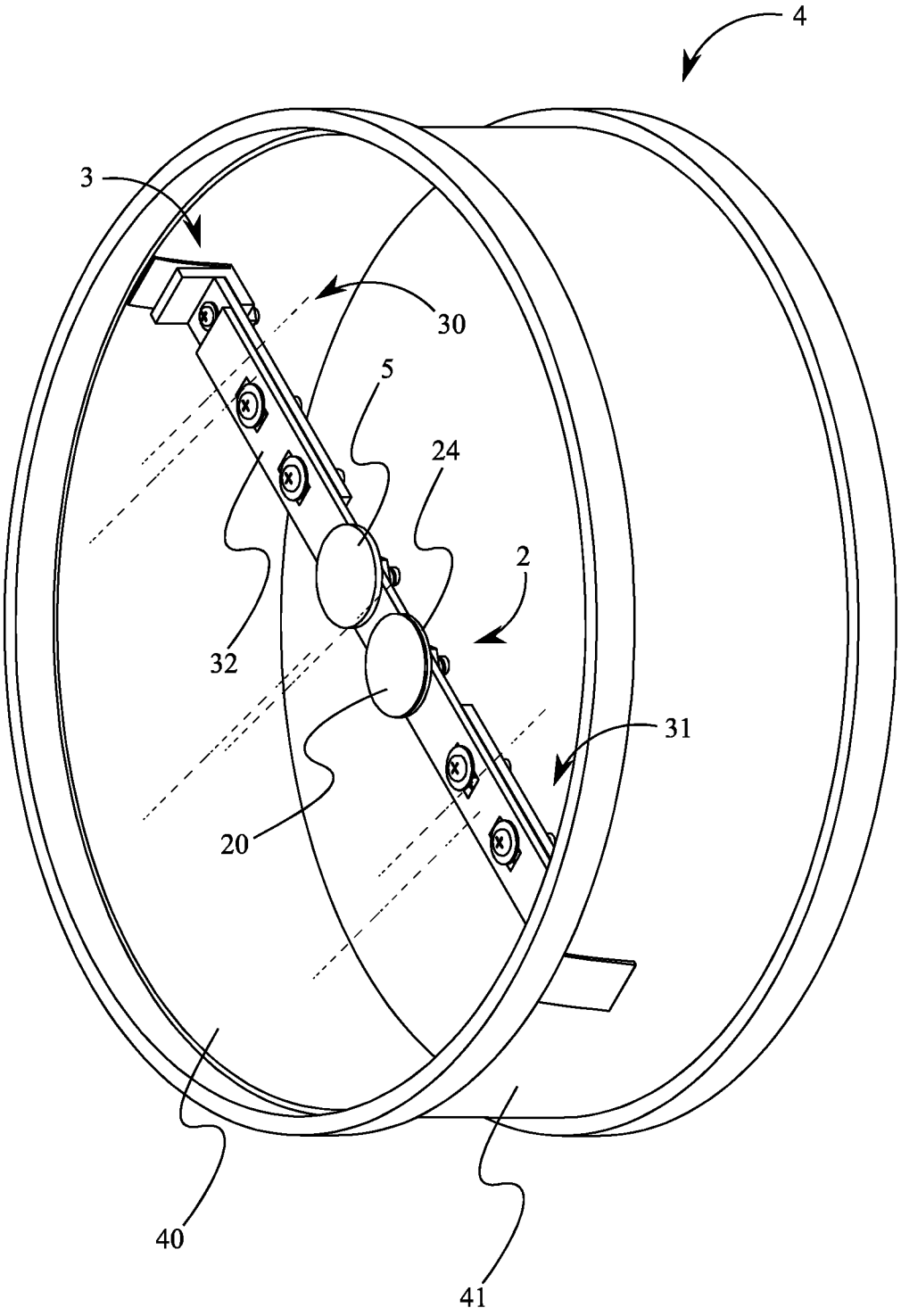
FIG. 20 is a perspective view of the suspension bracket in the alternative embodiment being secured to the drum shell.

In other embodiments, the crossbar 32 may comprise a plurality of central slots, allowing at least one subsequent impact pad 2 to be attached to the crossbar 32, as depicted in FIG. 20. This allows the present invention to be utilized with double pedal kick drum 4 configurations. Each of the central slots may be an elongated channel that allows the impact pad 2 and the subsequent impact pad 2 to slide parallel or perpendicular to the crossbar 32, depending on the orientation of the central slot. Alternatively, each of the center slots may employ a cross-shape configuration, allowing the position of the impact pad 2 and the subsequent impact pad 2 to be adjusted both vertically and horizontally. In this way, a user can adjust the distance between the impact pad 2 and the subsequent impact pad 2 to match the spacing of the dual pedal configuration.

The impact pad 2 may be mounted to the suspension bracket 3 in a number of different ways. In some embodiments, a nut and bolt fastening system is used to secure the impact pad 2 to the suspension bracket 3, allowing the position of the impact pad 2 to be adjusted. In other embodiments, the impact pad 2 may be secured to the suspension bracket 3 using an adhesive. In other embodiments, the impact pad 2 may be magnetically attached to the suspension bracket 3. In yet other embodiments, the impact pad 2 may be attached to the suspension bracket 3 using a snap connection.

Figure 21:
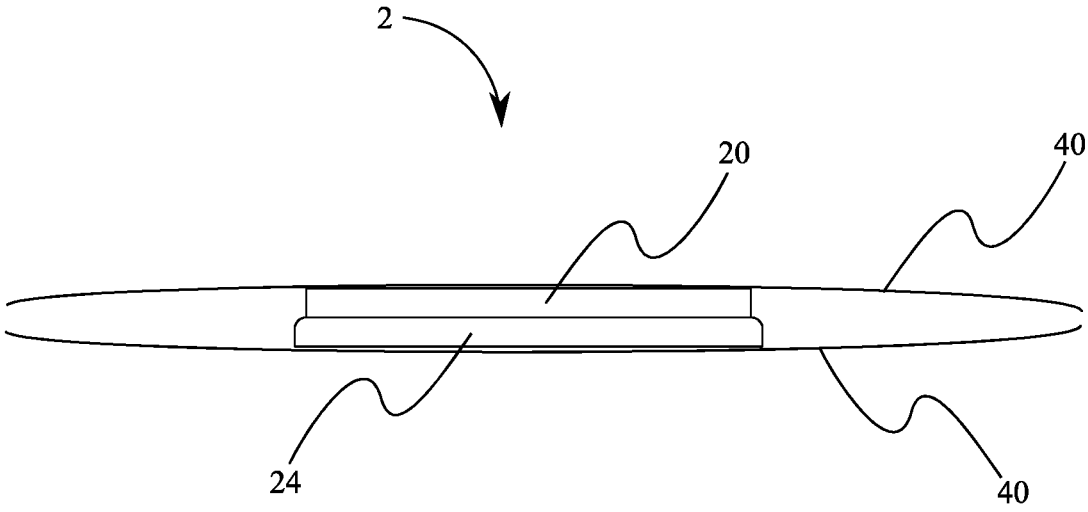
FIG. 21 is a bottom view of the impact pad, wherein the impact pad is positioned between the two plies of the batter head.

In reference to FIG. 21, in some embodiments of the present invention, the impact pad 2 may be integrated into the batter head 40, wherein the impact pad 2 is positioned in between the two plies of the batter head 40. The impact pad 2 may be adhered or otherwise secured to the top ply or the bottom ply. A hydraulic oil or other fluid may also be filled into the space between the two plies in order to suspend the impact pad 2.

Figure 18:
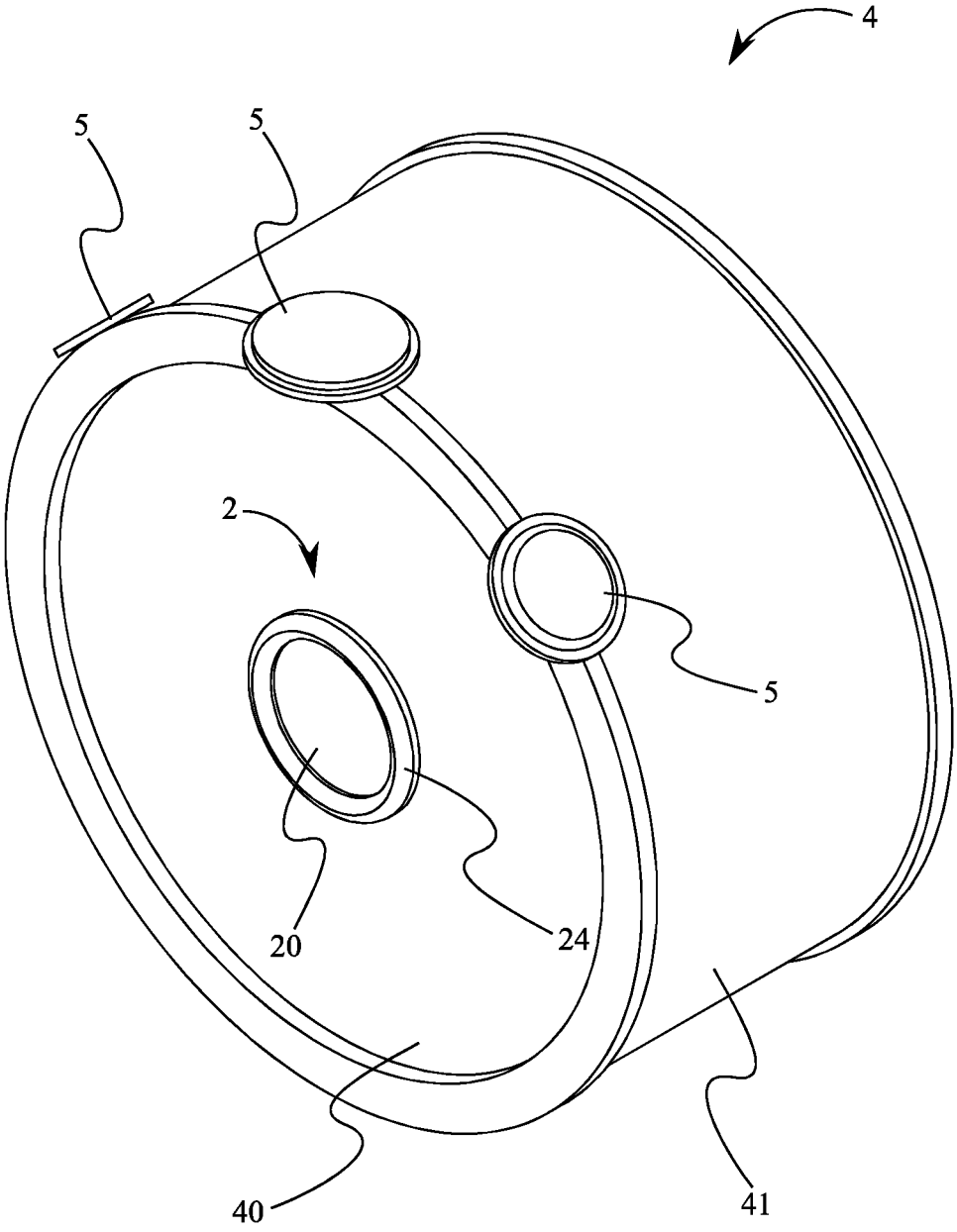
FIG. 18 is a perspective view of a kick drum and an alternative embodiment of the impact pad, wherein a plurality of subsequent impact pads is secured about the drum shell.

In reference to FIG. 18, the present invention may include one or more subsequent impact pads 5. Each of the one or more subsequent impact pads 5 may have a magnet with a different strength. This allows the user to add/swap the impact pad 2 with one of the one or more subsequent impact pads 5 in order to change the strength of the repulsion between the drum beater 1 and the batter head 40 of the kick drum 4 and the resonance of the kick drum 4. The impact pad 2 and each of the one or more subsequent impact pads 5 may be color coded to indicate the strength of the magnet. It is also possible for the impact pad 2 and any of the one or more impact pads 5 to be stacked in order to increase the repulsion force and further vary the resonance of the kick drum 4. Each of the one or more subsequent impact pads 5 is an independent body that may be stored on a metal portion of the kick drum 4 or somewhere else, detached from the kick drum 4, wherein the one or more subsequent impact pads 5 is easily accessible to the user to quickly swap out.

Although the invention has been explained in relation to its preferred embodiment, it is to be understood that many other possible modifications and variations can be made without departing from the spirit and scope of the invention as hereinafter claimed.

What is claimed is:

1. A magnetic resistance system for use with drum sets comprises:

a drum beater comprising a beater head, a beater magnet, and a beater pad;

an impact pad comprising an impact cover, an impact magnet, and a magnet housing;

the beater pad being adjacently connected to the beater head;

the beater magnet being embedded between the beater head and the beater pad;

a first pole of the beater magnet being oriented towards the beater head and a second pole of the beater magnet being oriented towards the beater pad;

the impact cover being adjacently connected to the magnet housing;

the impact magnet being embedded between the impact cover and the magnet housing;

a first pole of the impact magnet being oriented towards the magnet housing and a second pole of the impact magnet being oriented towards the impact cover;

the first pole of the beater magnet and the first pole of the impact magnet having the same polarity; and the second pole of the beater magnet and the second pole of the impact magnet having the same polarity.

2. The magnetic resistance system for use with drum sets, as claimed in claim 1 comprises:

the impact pad further comprises a double-sided adhesive; and the double-sided adhesive being adhered to the magnet housing opposite the impact cover.

3. The magnetic resistance system for use with drum sets, as claimed in claim 1 comprises:

the impact pad further comprising a protective membrane and a double-sided adhesive;

the protective membrane being adjacently connected to the magnet housing opposite the impact cover; and the double-sided adhesive being adhered to the protective membrane opposite the magnet housing.

4. The magnetic resistance system for use with drum sets, as claimed in claim 1 comprises:

a suspension bracket; and the impact pad being mounted to the suspension bracket.

5. The magnetic resistance system for use with drum sets, as claimed in claim 4 comprises:

the impact pad being slidably mounted to the suspension bracket.

6. The magnetic resistance system for use with drum sets, as claimed in claim 4 comprises:

the suspension bracket comprising a first shell mount, a second shell mount, and a crossbar;

the first shell mount and the second shell mount being terminally connected to the crossbar, opposite each other; and the impact pad being mounted to the crossbar.

7. The magnetic resistance system for use with drum sets, as claimed in claim 6 comprises:

the crossbar comprising a first slide rail and a second slide rail; and the first slide rail being slidably engaged with the second slide rail.

8. The magnetic resistance system for use with drum sets, as claimed in claim 4 comprises:

a kick drum;

the suspension bracket being mounted within the drum shell of the kick drum; and the impact pad being positioned adjacent to the batter head of the kick drum.

9. The magnetic resistance system for use with drum sets, as claimed in claim 1 comprises:

a first beater recess being formed into the beater head;

a second beater recess being formed into the beater pad; and the beater magnet being positioned within the first beater recess and the second beater recess.

10. The magnetic resistance system for use with drum sets, as claimed in claim 9 comprises:

the first beater recess being centered about the beater head; and the second beater recess being centered about the beater pad.

11. The magnetic resistance system for use with drum sets, as claimed in claim 1 comprises:

a first impact recess being formed into the magnet housing;

a second impact recess being formed into the impact cover; and the impact magnet being positioned within the first impact recess and the second impact recess.

12. The magnetic resistance system for use with drum sets, as claimed in claim 11 comprises:

the first impact recess being centered about the magnet housing; and the second impact recess being centered about the impact cover.

13. The magnetic resistance system for use with drum sets, as claimed in claim 1 comprises:

the drum beater further comprising a support rod; and the beater head being terminally connected to the support rod.

14. The magnetic resistance system for use with drum sets, as claimed in claim 1 comprises:

a kick drum; and the impact pad being mounted to the batter head of the kick drum.

15. The magnetic resistance system for use with drum sets, as claimed in claim 1 comprises:

a double-sided beater adhesive; and the double-sided beater adhesive being positioned in between the beater head and both the beater magnet and the beater pad.

16. The magnetic resistance system for use with drum sets, as claimed in claim 1 comprises:

a kick drum; and the impact pad being embedded in the batter head of the kick drum.

* * * * *